US009568208B2

(12) United States Patent
West et al.

(10) Patent No.: US 9,568,208 B2
(45) Date of Patent: Feb. 14, 2017

(54) HVAC ELECTRICAL SYSTEM POWER SUPPLY PACKAGING SYSTEM

(71) Applicant: TRANE INTERNATIONAL INC., Piscataway, NJ (US)

(72) Inventors: Nathan Thomas West, Holmen, WI (US); David Marshall Foye, La Crosse, WI (US); William James Walters, Rochester, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 14/681,750

(22) PCT Filed: Oct. 8, 2013

(86) PCT No.: PCT/US2013/063821

§ 371 (c)(1),
(2) Date: Apr. 8, 2015

(87) PCT Pub. No.: WO2014/058843

PCT Pub. Date: Apr. 17, 2014

(65) Prior Publication Data

US 2015/0330659 A1 Nov. 19, 2015

Related U.S. Application Data

(60) Provisional application No. 61/710,920, filed on Oct. 8, 2012.

(51) Int. Cl.

| | |
|---|---|
| ***F25B 49/02*** | (2006.01) |
| ***F24F 11/02*** | (2006.01) |
| ***F24F 11/00*** | (2006.01) |

(52) U.S. Cl.

CPC ..... *F24F 11/02* (2013.01); *F24F 11/0009* (2013.01); *F25B 49/025* (2013.01); *F25B 2600/0253* (2013.01)

(58) Field of Classification Search

CPC ..... F25B 49/02; F25B 49/022; F25B 49/025; F25B 2600/021; F25B 2600/0253; Y02B 30/741

(Continued)

(56) References Cited

U.S. PATENT DOCUMENTS 3,233,129 A * 2/1966 Schaefer ..... H02K 11/25 200/275
3,628,346 A * 12/1971 Lagrone, Jr. ..... F24F 11/00 62/126

(Continued)

FOREIGN PATENT DOCUMENTS

| | | |
|---|---|---|
| CN | 201266875 | 7/2009 |
| CN | 102611094 | 7/2012 |
| CN | 102624077 | 8/2012 |

OTHER PUBLICATIONS

"Danfoss VFD." Danfoss. N.p., Aug. 1, 2004. Web. Jun. 14, 2016.*

(Continued)

*Primary Examiner* — Jonathan Bradford
(74) *Attorney, Agent, or Firm* — Hamre, Schumann, Mueller & Larson, P.C.

(57) ABSTRACT

Embodiments of a HVAC electrical system power supply packaging system within an ultimate enclosure are provided. The HVAC electrical system power supply packaging system provides serviceability, safety, manufacturability, and system management failure diagnostic reporting enhancements over conventional packaging systems while conforming to agency safety requirements. The embodiments disclosed herein also reduce equipment and service costs for HVAC electrical system power supply components provided within the HVAC electrical system power supply packaging system by reducing delays in servicing these components. Thus, customer uptime of the HVAC system can be increased.

17 Claims, 6 Drawing Sheets

(58) Field of Classification Search
USPC ..... 62/228.4
See application file for complete search history.

(56) References Cited

U.S. PATENT DOCUMENTS

| | | | | |
|---|---|---|---|---|
| 3,896,353 | A * | 7/1975 | Burton | H02B 1/36 200/50.26 |
| 4,082,999 | A | 4/1978 | Staker | |
| 4,431,134 | A | 2/1984 | Hendricks et al. | |
| 4,455,449 | A | 6/1984 | Rendel | |
| 4,968,338 | A * | 11/1990 | Sugiyama | F04B 49/065 361/22 |
| 5,245,221 | A | 9/1993 | Schmidt et al. | |
| 5,283,474 | A | 2/1994 | Oi et al. | |
| 5,289,046 | A | 2/1994 | Gregorich et al. | |
| 5,460,327 | A | 10/1995 | Hill et al. | |
| 5,899,081 | A | 5/1999 | Evans et al. | |
| 6,278,910 | B1 * | 8/2001 | Miura | F04B 49/065 318/803 |
| 6,366,448 | B1 * | 4/2002 | Berndt | H02B 1/32 200/50.21 |
| 6,422,351 | B2 | 7/2002 | Tajima et al. | |
| 7,038,132 | B1 * | 5/2006 | Lowe | H02G 3/105 174/50 |
| 7,201,010 | B2 * | 4/2007 | Homan | B60H 1/004 62/228.4 |
| 7,202,626 | B2 | 4/2007 | Jadric et al. | |
| 7,425,806 | B2 | 9/2008 | Schnetzka et al. | |
| 8,278,778 | B2 * | 10/2012 | Rockenfeller | H02J 9/062 165/58 |
| 8,759,674 | B2 * | 6/2014 | Korcz | H02G 3/14 174/480 |
| 2002/0064695 | A1 * | 5/2002 | Raiser | B60L 11/1885 429/432 |
| 2005/0035664 | A1 * | 2/2005 | Zver | H02J 9/062 307/115 |
| 2006/0200542 | A1 * | 9/2006 | Willig | H04L 12/10 709/223 |
| 2010/0188038 | A1 * | 7/2010 | Shibuya | H02M 7/53875 318/722 |
| 2010/0264736 | A1 | 10/2010 | Muntaz et al. | |
| 2011/0018472 | A1 * | 1/2011 | Rockenfeller | H02P 5/74 318/51 |
| 2011/0206544 | A1 * | 8/2011 | Saito | F04B 39/121 417/410.1 |
| 2011/0209913 | A1 * | 9/2011 | Green | H02G 3/081 174/520 |
| 2012/0119688 | A1 * | 5/2012 | Hattori | H02M 7/003 318/400.25 |
| 2012/0131217 | A1 * | 5/2012 | Delorme | G06Q 10/06 709/230 |
| 2012/0183420 | A1 * | 7/2012 | Taguchi | F04B 39/06 417/422 |
| 2012/0191252 | A1 | 7/2012 | Rockenfeller et al. | |
| 2013/0069494 | A1 * | 3/2013 | Hattori | F04B 35/04 310/68 D |

OTHER PUBLICATIONS

"Solid-State Circuits for Variable-Frequency Drives." Industrial Electronics. N.p., Aug. 6, 2012. Web. Jun. 14, 2016.*

International Search Report and Written Opinion for International Application No. PCT/US2013/063821, dated Jun. 18, 2014, 10 pgs.

* cited by examiner

HVAC ELECTRICAL SYSTEM POWER SUPPLY PACKAGING SYSTEM

The embodiments disclosed herein relate generally to heating, ventilation, air conditioning (HVAC) systems. More particularly, the embodiments relate to a HVAC electrical system power supply packaging system within an ultimate enclosure.

BACKGROUND

A HVAC system typically includes a compressor, a condenser, an evaporator and an expansion valve forming a refrigeration circuit. The HVAC system also typically includes a number of electrical and mechanical components (e.g., a power supply, a Variable Frequency Drive (VFD), and a motor to run the refrigeration circuit. These and other components of the HVAC system may require NEC class 1 voltage levels to operate correctly. These voltage levels can be hazardous to service personnel who are exposed to these voltage levels while assembling and servicing components of the HVAC.

SUMMARY

The embodiments disclosed herein relate generally to heating, ventilation, air conditioning (HVAC) systems. More particularly, the embodiments relate to a HVAC electrical system power supply packaging system within an ultimate enclosure.

In particular, a HVAC electrical system power supply packaging system within an ultimate enclosure is provided in which high voltage components and low voltage components are separated by a physical barrier and electric circuitry connecting the low voltage components is electrically separated from electric circuitry connecting the high voltage components.

The embodiments described herein provide serviceability, safety, manufacturability, and system management failure diagnostic reporting enhancements over conventional packaging systems while conforming to agency safety requirements. The embodiments disclosed herein also reduce equipment and service costs for HVAC electrical system power supply components provided within the HVAC electrical system power supply packaging system by reducing delays in servicing these components. Thus, customer uptime of the HVAC system can be increased.

In some embodiments, the HVAC electrical system power supply packaging system is provided for a HVAC system that includes a motor to be operated at variable speeds and a variable frequency power converter providing variable frequency voltages and currents to the motor. In some embodiments, the HVAC system includes a Variable Frequency Drive (VFD).

In some embodiments, a first aspect is provided such that the HVAC electrical system power supply packaging system within the ultimate enclosure includes a physical partitioning of NEC class 1 and non-hazardous low voltage circuits. Also, the HVAC electrical system power supply packaging system is configured to prevent service personnel exposure to hazardous voltage.

In some embodiments, a second aspect is provided such that the HVAC electrical system power supply packaging system includes a plurality of visible indicators (regarding e.g., power sources, critical signals, etc.) that provide status information for use, for example, by service personnel.

In some embodiments, a third aspect is provided such that the HVAC electrical system power supply packaging system includes a transparent barrier to provide incidental physical protection for control electronic components housed within the HVAC electrical system power supply packaging system. In some embodiments, the transparent barrier is formed of plastic.

In some embodiments, a fourth aspect is provided such that the HVAC electrical system power supply packaging system includes a non-hazardous low voltage control circuit power supply that is independent of one or more other power supplies in the HVAC electrical system power supply packaging system. The non-hazardous low voltage control circuit power supply is configured to operate one or more control electronic circuits within the HVAC electrical system power supply packaging system without the presence of a hazardous voltage (e.g. NEC class 1 power) in a service accessible location of the HVAC electrical system power supply packaging system. Accordingly, service personnel can avoid exposure to hazardous voltage levels during servicing. In some embodiments, the non-hazardous low voltage control circuit power supply can include two 12V batteries that are connected to the one or more control electronic circuits within the HVAC electrical system power supply packaging system via, for example, an extension cord.

In some embodiments, a fifth aspect is provided such that an independent low voltage power supply can be used to operate the one or more control electronic circuits within the HVAC electrical system power supply packaging system when NEC class 1 line power is not available or not desired, such as during, servicing. In some embodiments, the independent low voltage power supply can be, for example, a 12V battery, a laptop power supply, etc.

In some embodiments, a sixth aspect is provided such that a control unit within the HVAC electrical system power supply packaging system is configured to provide diagnostic information to an external control unit (e.g., a VFD control unit) that enables service diagnosis of, for example, VFD operation without physical access to the VFD compartment. In some embodiments, the HVAC electrical system power supply packaging system includes an operator display unit and a service tool unit to provide the diagnostic information to service personnel.

In some embodiments, a seventh aspect is provided such that a control unit within the HVAC electrical system power supply packaging system is configured to provide, for example, VFD operation and diagnostic information to a control unit external the VFD that enables service diagnosis of VFD operation with physical access to the VFD compartment through the use of visual indicators. In some embodiments, the visual indicators include lights on the VFD compartment that service personnel can use to obtain VFD operation and diagnostic information.

In some embodiments, an eighth aspect is provided such that a control unit in the HVAC electrical system power supply packaging system can provide a secondary process of VFD operation can be provided that supplies limited voltage and/or limited energy from a secondary non-hazardous low voltage supply to a National Electric Code (NEC) class 1 portion of the VFD, while providing full control circuit operation of the VFD. In some embodiments, the secondary non-hazardous low voltage supply can be the independent low voltage power supply or the non-hazardous low voltage control circuit power supply.

In some embodiments, a ninth aspect is provided such that each of the first through eighth aspects can be applied to a VFD system that is either complete or partially assembled.

Thus, service and manufacturing diagnostic testing and observation of proper operation can be performed by service personnel while ensuring that the service personnel are safe from, for example, hazardous voltages.

In some embodiments, the HVAC electrical system power supply packaging system provides an electrical connection and circuit partitioning to provide conformance to non-hazardous low voltage energy limits, while providing safe low voltage operation of the VFD control circuits to provide support elements for the first through ninth aspects.

In some embodiments, the HVAC electrical system power supply packaging system provides Metal Oxide Varistors (MOVs) outside of the VFD frame envelope to facilitate service and minimize damage to other components within the HVAC electrical system power supply packaging system in the event of a power failure.

Other aspects of the invention will become apparent by consideration of the detailed description and accompanying drawings.

BRIEF DESCRIPTION OF THE DRAWINGS

Referring now to the drawings in which like reference numbers represent corresponding parts throughout.

DETAILED DESCRIPTION

The embodiments disclosed herein relate generally to heating, ventilation, air conditioning (HVAC) systems. More particularly, the embodiments relate to a HVAC electrical system power supply packaging system within an ultimate enclosure.

References are made to the accompanying drawings that form a part hereof, and in which is shown by way of illustration of the embodiments in which the methods and systems described herein may be practiced.

While the embodiments described below are directed to HVAC electrical systems that include a variable frequency drive (VFD), it will be appreciated that other types of motor drives could be used. Also, while the embodiments described below are directed to chiller systems, it will be appreciated that other types HVAC systems, including unitary HVAC systems could include a HVAC electrical system power supply packaging system as described herein.

Figure 1:
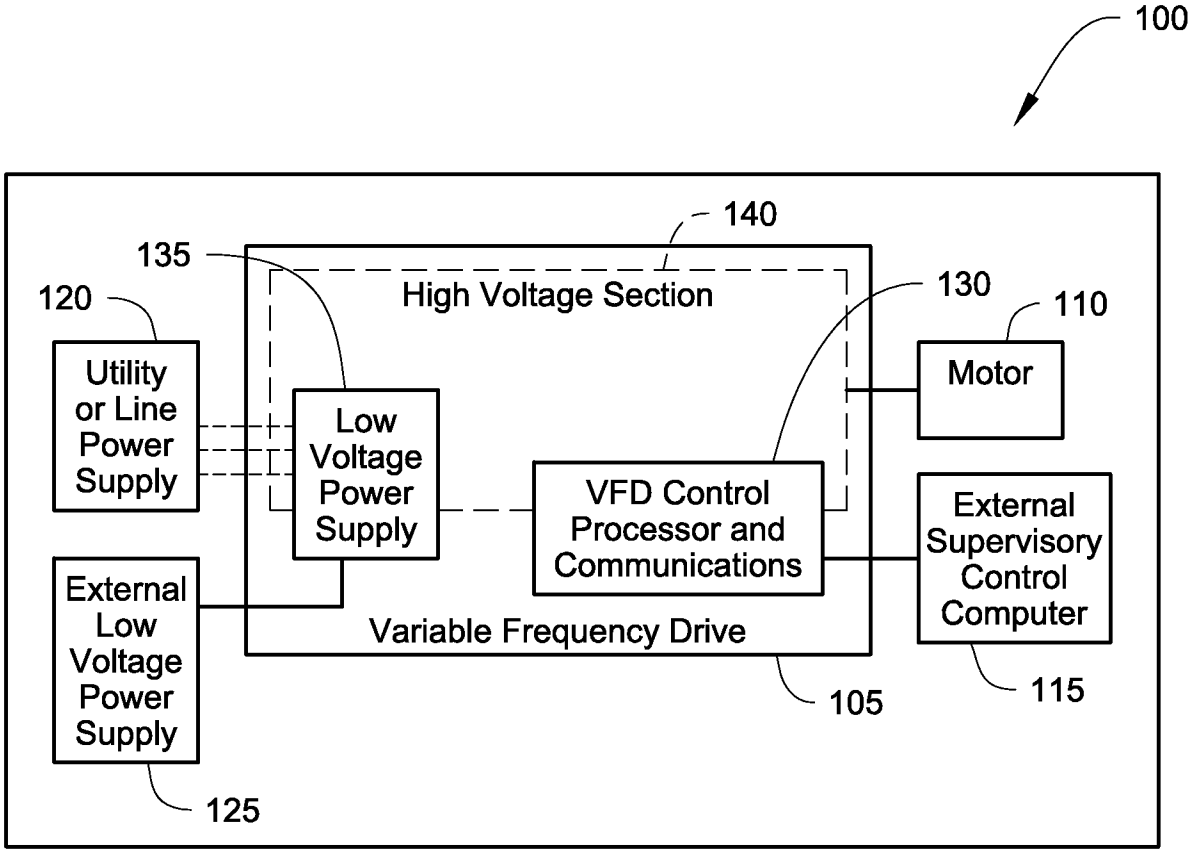
FIG. 1 illustrates a block diagram of a HVAC electrical system power supply packaging system, according to one embodiment.

FIG. 1 illustrates a block diagram of a HVAC electrical system power supply packaging system 100, according to one embodiment. The HVAC electrical system power supply packaging system 100 includes a variable frequency drive (VFD) 105, a motor 110, an external supervisory control computer 115, a utility or line power supply 120 and an external low voltage power supply 125. The HVAC electrical system power supply packaging system 200 is configured to be provided in an electronic enclosure (not shown).

While the HVAC electrical system power supply packaging system 100 is provided for a HVAC system that includes a VFD 105, in other embodiments the HVAC electrical system power supply packaging system 100 can be provided for HVAC systems that do not include a VFD.

In some embodiments, components of the HVAC electrical system power supply packaging system 100 (e.g., the VFD 105, the motor 110, the external supervisory control computer 115, the utility or line power supply 120, the external low voltage power supply 125, etc.) can be either completely or partially assembled. Thus, service and manufacturing diagnostic testing and observation of proper operation can be performed by service personnel while ensuring that the service personnel are safe from, for example, hazardous voltages.

In some embodiments, the utility or line power supply 120 is configured to provide NEC class 1 voltage to the VFD 105 during standard operation. The power supplied by the utility or line power supply 120 can generate hazardous voltage levels within the HVAC electrical system power supply packaging system 100. Accordingly, portions of the HVAC electrical system power supply packaging system 100 can be unsafe when power is being supplied by the utility or line power supply 120.

In some embodiments, the external low voltage power supply 125 is a non-hazardous low voltage control circuit power supply that is independent of the utility or line power supply 120 and the low voltage power supply 135. The external low voltage power supply 125 is configured to operate, for example, the VFD control processor and communications unit 130 without the presence of a hazardous voltage (e.g. NEC class 1 power from, for example, the utility or line power supply 120) in a service accessible location of the HVAC electrical system power supply packaging system 100. Accordingly, service personnel can avoid exposure to hazardous voltage levels during servicing. In some embodiments, the external low voltage power supply 125 can include two 12V batteries that are connected to the low voltage power supply 135 via, for example, an extension cord (not shown).

The VFD 105 includes a low voltage power supply 135 and a VFD control processor and communications unit 130, a low voltage power supply and a high voltage section 140. As shown in FIG. 1, portions of the low voltage power supply 135 and the VFD control processor and communications unit 130 are provided in the high voltage section 140. Both the Utility or line power supply 120 and the external low voltage power supply 125 are connected to the low voltage power supply 135 and provide power to the VFD 105.

In some embodiments, the low voltage power supply 135 is configured to operate, for example, the VFD control processor and communications unit 130 when NEC class 1 line power from the utility or line power supply 120 is not available or not desired, such as during, servicing. In some embodiments, the low voltage power supply 135 can be, for example, a 12V battery, a laptop power supply, etc.

The motor 110 is connected to the high voltage section 140 of the VFD 105. The VFD 105 is configured to operate the motor 110 at variable speeds and provide variable frequency voltages and currents to the motor 110.

The external supervisory control computer 115 is connected to the VFD control processor and communications unit 130. In some embodiments, the VFD control processor and communications unit 130 is configured to provide diagnostic information to the external supervisory control computer 115 that enables service diagnosis of, for example, VFD operation without physical access to the VFD 105. In some embodiments, the HVAC electrical system power supply packaging system 100 includes an operator display unit (not shown) and a service tool unit (not shown) to provide the diagnostic information to service personnel.

In some embodiments, the VFD control processor and communications unit 130 is configured to provide, for example, VFD operation and diagnostic information to the external supervisory control computer 115 that enables service diagnosis of VFD operation with physical access to the VFD 105 through the use of visual indicators (not shown). In some embodiments, the visual indicators include lights on an external surface of a housing (not shown) of the VFD 105 that service personnel can use to obtain VFD operation and diagnostic information.

In some embodiments, the VFD control processor and communications unit 130 can provide a secondary process of VFD operation that supplies limited voltage and/or limited energy from the low voltage power supply 135 or the external low voltage power supply 125 to the high voltage section 140 of the VFD 105, while providing full control of the VFD 105 via the VFD control processor and communications unit 130.

In some embodiments, the HVAC electrical system power supply packaging system 200 provides Metal Oxide Varistors (MOVs) (not shown) outside of the VFD 105 to facilitate service and minimize damage to other components within the HVAC electrical system power supply packaging system 100 in the event of a power failure.

In some embodiments, the HVAC electrical system power supply packaging system 100 provides an electrical connection and circuit partitioning to provide conformance to non-hazardous low voltage energy limits, while providing safe low voltage operation of the VFD 105.

Figure 2:
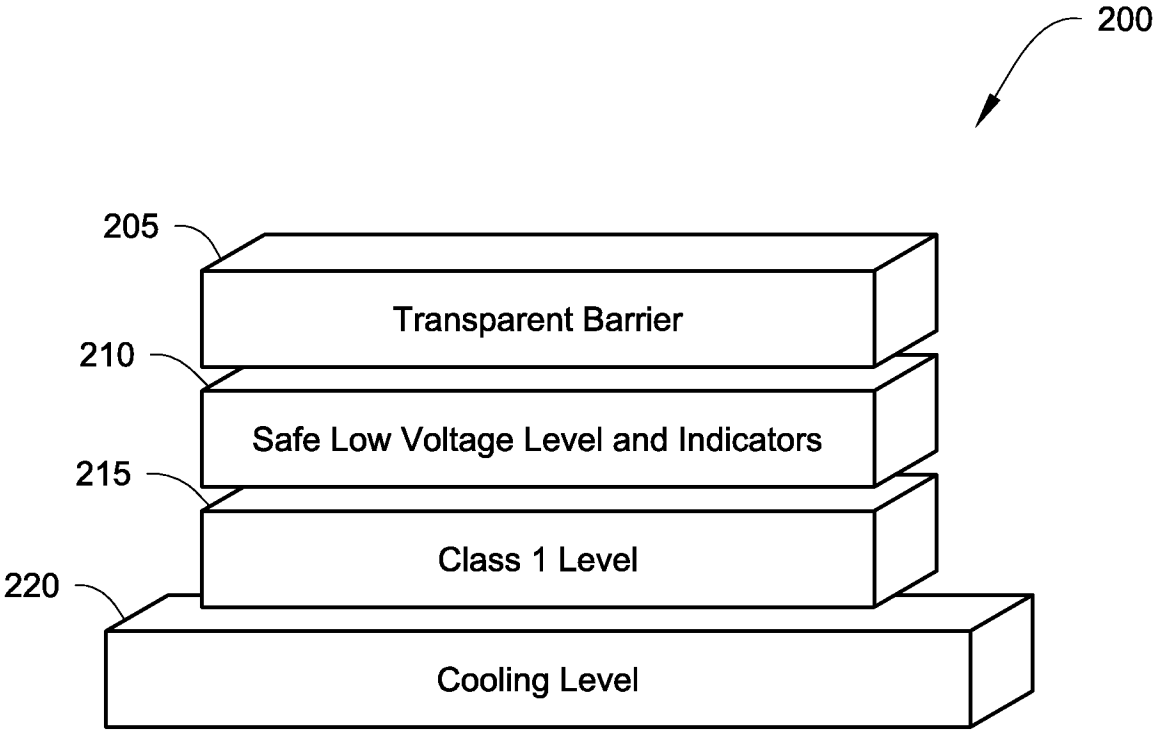
FIG. 2 illustrates a layered view of components within a HVAC electrical system power supply packaging system, according to one embodiment.

FIG. 2 illustrates a layered view of components within a HVAC electrical system power supply packaging system 200, according to one embodiment. This layered view illustrates how components within the HVAC electrical system power supply packaging system 200 are arranged to prevent service personnel from being exposed to hazardous voltage levels. The HVAC electrical system power supply packaging system 200 includes a transparent barrier layer 205 that is closest to where service personnel will have access to components within the HVAC electrical system power supply packaging system 200. Behind the transparent barrier layer 205 is a safe low voltage level and indicators layer 210. Behind the safe low voltage level and indicators layer 210 is a class 1 level layer 215 that can include components operating at a hazardous voltage level. Behind the class 1 level layer 215 is a cooling level layer 220 that is further from where service personnel have access to the HVAC electrical system power supply packaging system 200.

In some embodiments, the transparent barrier layer 205 includes a transparent barrier (not shown) that is configured to provide incidental physical protection for control electronic components housed within the HVAC electrical system power supply packaging system 200. In some embodiments, the transparent barrier is formed of plastic.

In some embodiments, a third aspect is provided such that the HVAC electrical system power supply packaging system includes a transparent barrier to provide incidental physical protection for control electronic components housed within the HVAC electrical system power supply packaging system. In some embodiments, the transparent barrier is formed of plastic.

In some embodiments, the HVAC electrical system power supply packaging system 200 includes a physical partition (not shown) between the class 1 level layer 215 and the safe low voltage level and indicators layer 210. The physical partition is configured to prevent service personnel from exposure to hazardous voltage that may be at the class 1 level layer 215.

In some embodiments, the safe low voltage level and indicators layer 210 can include a one or more visible indicators (not shown) regarding e.g., power sources, critical signals, etc. that provide status information for use, for example, by service personnel.

Figure 3:
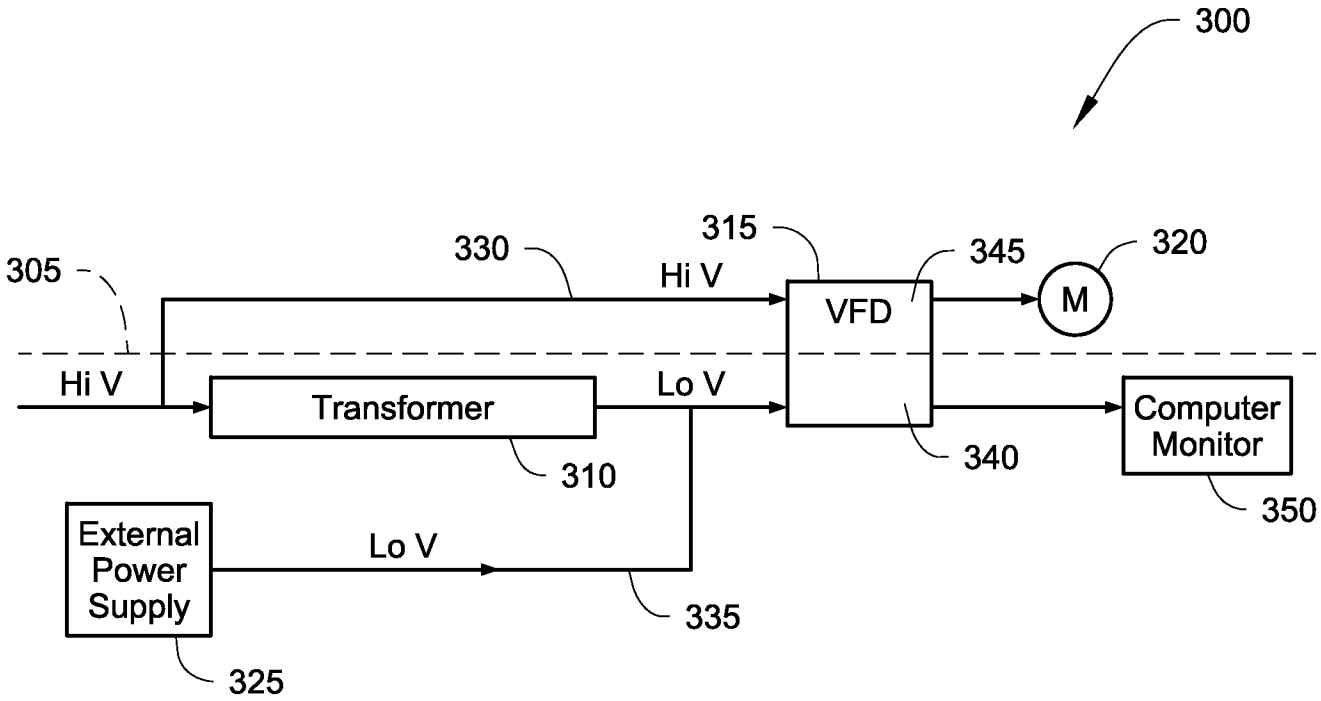
FIG. 3 illustrates a block diagram of components within a HVAC electrical system power supply packaging system, according to another embodiment.

FIG. 3 illustrates a block diagram of components within a HVAC electrical system power supply packaging system 300, according to another embodiment. The HVAC electrical system power supply packaging system 300 includes a transport barrier 305 that separates a high voltage side 330 from a low voltage side 335. The HVAC electrical system power supply packaging system 300 also includes a transformer 310, a VFD 315, a motor 320 and an external low voltage power supply 325.

The high voltage side 330 can expose service personnel to, for example, NEC class 1 level voltage levels that can be hazardous to service personnel. The low voltage side 335 is configured such that service personnel are only exposed to non-hazardous voltages levels. In some embodiments, NEC class 1 level voltages can be voltage levels over about 50 volts, and non-hazardous voltages can be voltage levels below about 50 volts.

The transparent barrier 305 is configured to provide incidental physical protection for control electronic components housed within the HVAC electrical system power supply packaging system 300. The transparent barrier 305 is also configured to allow service personnel access to components within the HVAC electrical system power supply packaging system 300 at the low voltage side 335 without being exposed to hazardous voltage levels from components on the high voltage side 330. In some embodiments, the transparent barrier 305 is formed of plastic. The transport barrier 305 is also configured to allow service personnel, from the low voltage side 335, to view a plurality of visible indicators that are located on components on the high voltage side 330 and that provide status information (regarding e.g., power sources, critical signals, etc.) to the service personnel.

As shown in FIG. 3, the VFD 315 includes a first portion 340 located on the low voltage side 335 of the HVAC electrical system power supply packaging system 300 and a second portion 345 located on the high voltage side 330 of the HVAC electrical system power supply packaging system 300. The first portion 340 of the VFD 315 can be connected to an external supervisory control computer 350 and is configured to receive low voltage power from the transformer 310 or the external power supply 325. The second portion 345 is connected to the motor 320 and is configured to receive a high voltage power from a high voltage power source (not shown).

In some embodiments, the first portion 340 includes a VFD control processor and communications unit (such as the VFD control processor and communications unit 130 in FIG. 1) that is configured to provide diagnostic information to the external supervisory control computer 350 that enables service personnel to obtain service diagnosis information of, for example, VFD operation without physical access to the VFD 105.

In some embodiments, the second portion 345 can include a variable frequency power converter that is configured to receive high voltage power from a high voltage power source (not shown) and provide variable frequency voltages and currents to the motor 320. The variable frequency voltages and currents provided to the motor 320 can be hazardous to service personnel who are exposed to these voltages and currents.

The motor 320 is disposed at the high voltage side 330 of the HVAC electrical system power supply packaging system 300 and is configured to be operated at variable speeds based on the variable frequency voltages and currents supplied by the second portion 345 of the VFD 315.

The transformer 310 is located on the low voltage side 335 of the HVAC electrical system power supply packaging system 300 and is configured to receive high voltage power from the high voltage power source and transform the high voltage power into low voltage power. The transformer 310 is connected to the first portion 340 of the VFD 315 and is configured to supply low voltage power to the first portion 340.

The external power supply 325 is provided on the low voltage side 335 of the HVAC electrical system power supply packaging system 300 and is configured to provide low voltage power to the first portion 340 of the VFD 315. In some embodiments, the external power supply 325 is a non-hazardous low voltage control circuit power supply that is independent of a utility or line power supply. The external power supply 325 is configured to operate, for example, a VFD control processor and communications unit (not shown) located at the first portion 340 of the VFD 310 in a service accessible location of the HVAC electrical system power supply packaging system 300. Accordingly, service personnel can avoid exposure to hazardous voltage levels during servicing. In some embodiments, the external power supply 325 can include two 12V batteries that are connected to the first portion 340 of the VFD 315 via, for example, an extension cord (not shown).

Figure 4:
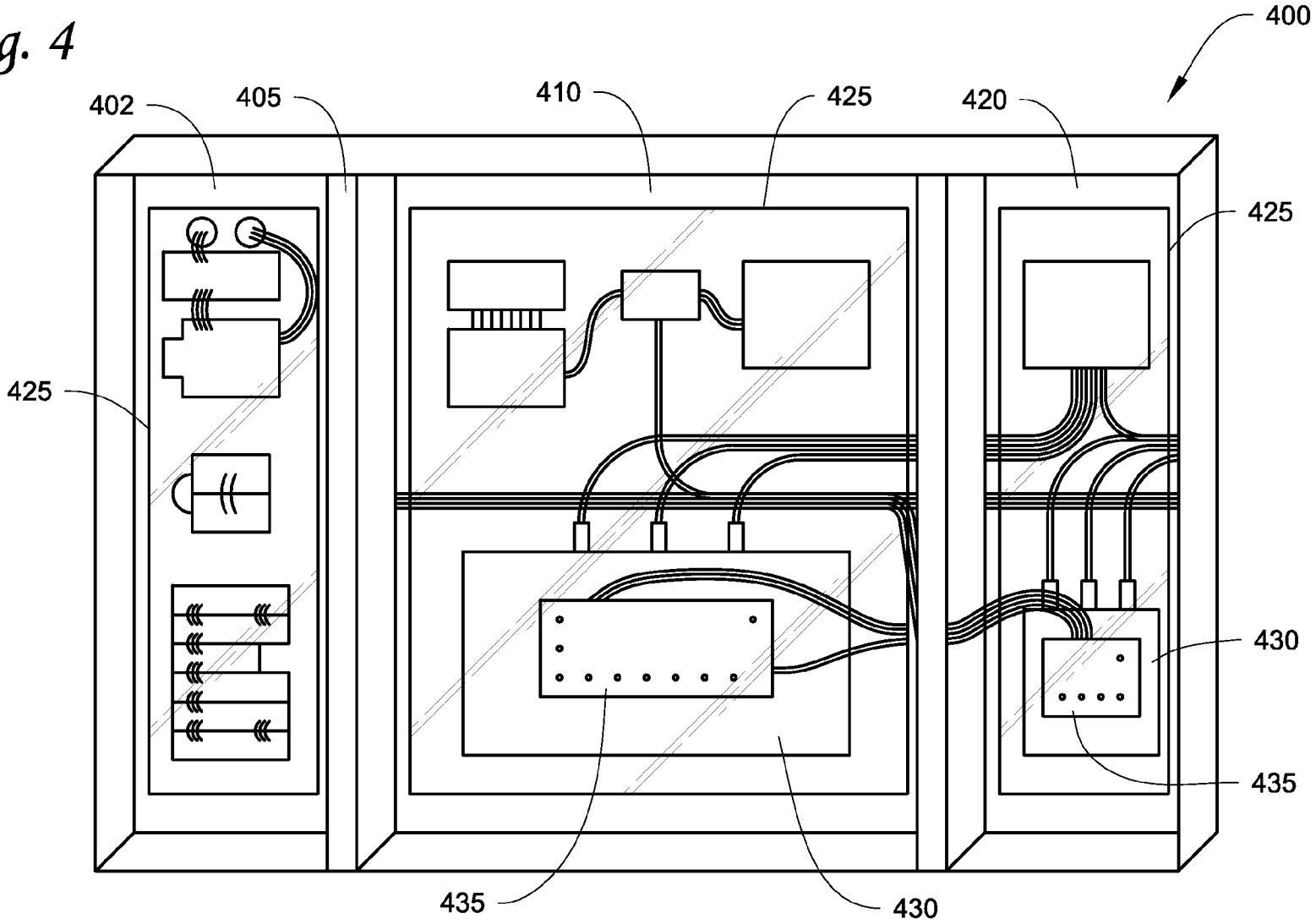
FIG. 4 illustrates a front view of a HVAC electrical system power supply packaging system, according to one embodiment.

FIG. 4 illustrates a front view of a HVAC electrical system power supply packaging system 400, according to one embodiment. The HVAC electrical system power supply packaging system 400 includes a low voltage compartment 402, a first high voltage compartment 410 and a second high voltage compartment 420.

Components in the low voltage compartment 402 are physically separated from components of the first high voltage compartment 410 via the first partition 405. The components in the first high voltage compartment 410 need not be physically separated from components in the second high voltage compartment 420, but can be if desired by user and service personnel. The first partition 405 allows service personnel to access components in the low voltage compartment 402 without being exposed to, for example, NEC class 1 level voltage levels, that are used by components in the first and second high voltage compartments 410, 420. Thus, the low voltage compartment 402 is configured such that service personnel are only exposed to non-hazardous voltages levels.

A transparent barrier 425 is provided in front of the low voltage compartment 402 and the first and second high voltage compartments 410, 420. The transparent barrier 425 is configured to provide incidental physical protection for control electronic components housed within the HVAC electrical system power supply packaging system 400. In some embodiments, the transparent barrier 425 is formed of plastic. The transport barrier 425 is also configured to allow service personnel to view a plurality of visible indicators that are housed in the first and second high voltage compartments 410, 420 and that provide status information (regarding e.g., power sources, critical signals, etc.) to the service personnel.

The first and second high voltage compartments 410, 420 each house a VFD enclosure 430. A status indicator circuit board 435 is provided on an external surface of each of the VFD enclosures 430. The status indicator circuit boards 435 are each configured to provide, for example, VFD operation and diagnostic information to service personnel through the use of visual indicators. In some embodiments, the visual indicators include one or more lights on the status indicator circuit boards 430 that service personnel can use to obtain VFD operation and diagnostic information. Thus, service personnel can obtain diagnostic information of VFDs (not shown) provided in the VFD enclosures without being exposed to hazardous voltage levels.

Figure 5:
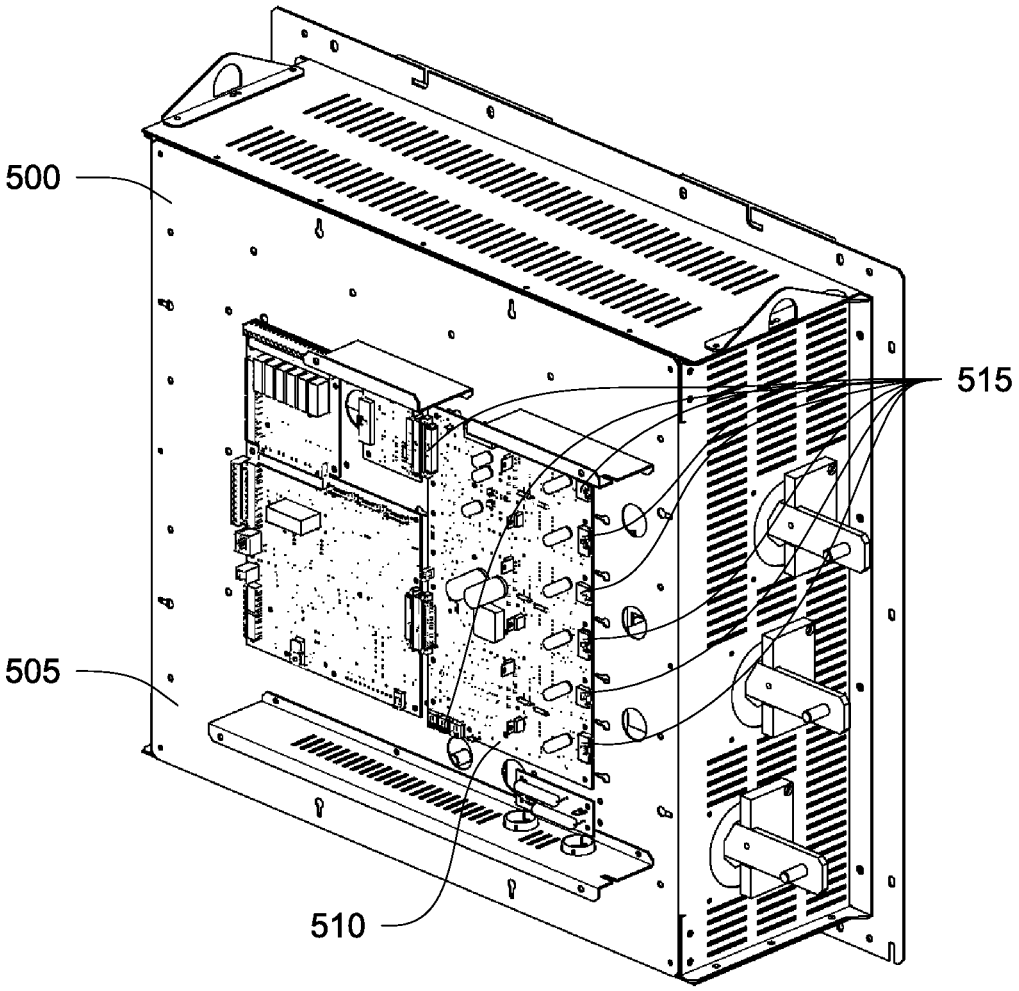
FIG. 5 illustrates a perspective view of a VFD enclosure, according to one embodiment.

FIG. 5 illustrates a perspective view of a VFD enclosure 500, according to one embodiment. The VFD enclosure 500 is configured to house a VFD (not shown). A status indicator circuit board 510 is provided on an external surface 505 of the VFD enclosure 500. The status indicator circuit board 510 includes status indicator lights 515 that are configured to indicate VFD operation and diagnostic information to service personnel.

Figure 6:
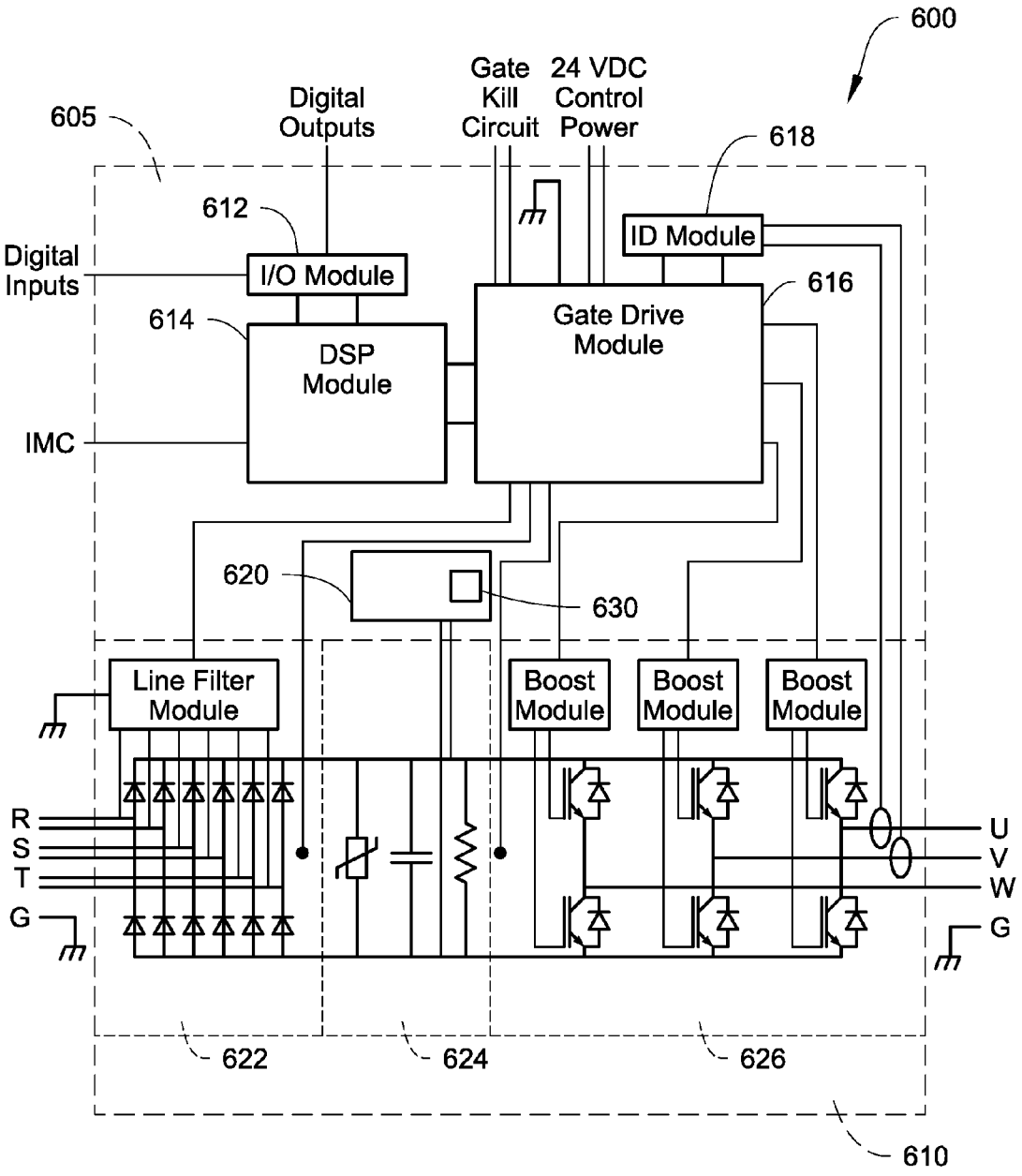
FIG. 6 illustrates an electrical schematic of a VFD, according to one embodiment.

FIG. 6 illustrates an electrical schematic of a VFD 600 according to one embodiment. The VFD 600 includes a low voltage portion 605 and a high voltage portion 610. The low voltage portion 605 includes control circuitry components for controlling operation of the VFD 600 including an input/output module 612, a digital signal processor module 614, a gate drive module 616, an identification module 618 and a bus indicator module 620. The input/output module 612, the digital signal processor module 614, the gate drive module 616, and the identification module 618 are all configured to operate at a non-hazardous low voltage level. In some embodiments, the non-hazardous low voltage level can be about 24 volts maximum.

The high voltage portion 610 includes high power circuitry components including a rectifier section 622, a DC bus 624 and an inverter section 626 that are all configured to operate at a hazard high voltage level (e.g., a NEC class 1 level voltage).

The input/output module 612 is connected to the digital signal processor module 614 and is configured to receive digital inputs external the VFD 600 and transmit digital outputs out of the VFD 600. The digital signal processor module 614 is connected to the input/output module 612 and the gate drive module 616. The gate drive module 616 is connected to the digital signal processor module 614, the identification module 618, the rectifier section 622 and the inverter section 624.

The bus indicator module 620 is configured to indicate a voltage level of the high voltage components provided in the high voltage portion 610. Accordingly, the bus indicator module 620 at times may have a hazardous high voltage level. In the embodiment shown in FIG. 6, the bus indicator module 620 is connected to the DC bus 624. The bus indicator module 620 includes an indicator 630 (e.g., a light) that is configured to indicate to a service provider of the VFD 600 when a voltage level of the high power circuitry components provided in the high voltage section 610 is at or below a low voltage level. Accordingly, the VFD 600 can indicate to service provider when it is safe to operate and work with the VFD 600.

Aspects:

It is noted that any of aspects 1-11, 12-15 and 16-22 can be combined.

Aspect 1. A heating, ventilation and air conditioning (HVAC) electrical system power supply packaging system within an ultimate enclosure comprising:

a low voltage compartment including a low voltage component configured to use non-hazardous low voltage power;

a high voltage compartment including a high voltage component configured to use hazardous high voltage power;

a partition configured to physically separate the low voltage component from the high voltage component, wherein the low voltage compartment includes low voltage circuitry and the high voltage compartment includes high voltage circuitry that is electrically isolated from the low voltage circuitry.

Aspect 2. The HVAC electrical system power supply packaging system of aspect 1, further comprising:

a transparent barrier provided in front of at least one of the low voltage compartment and the high voltage compartment, wherein the transparent barrier is configured to allow a visible indicator housed within at least one of the high voltage compartment and the low voltage compartment to be viewed external the ultimate enclosure.

Aspect 3. The HVAC electrical system power supply packaging system of any of aspects 1-2, further comprising:

a variable frequency drive (VFD) enclosure including a status indicator circuit board on an external surface of the VFD enclosure, a visible indicator provided on the status indicator circuit board, the visible indicator configured to provide VFD operation and diagnostic information.

Aspect 4. The HVAC electrical system power supply packaging system of any of aspects 1-3, further comprising:

a motor provided in the high voltage compartment as a high voltage component; and a VFD configured to drive the motor, the VFD provided in a VFD enclosure, wherein the VFD includes a first portion located on a low voltage side of the VFD that includes VFD low voltage circuitry and a second portion located on a high voltage side of the VFD that includes VFD high voltage circuitry.

Aspect 5. The HVAC electrical system power supply packaging system of aspect 4, further comprising:

a VFD control processor and communications unit provided in the low voltage compartment and configured to provide diagnostic information of the VFD to an external computer.

Aspect 6. The HVAC electrical system power supply packaging system of aspect 4, further comprising:

a non-hazardous low voltage control circuit power supply configured to operate the VFD without the hazardous high power voltage.

Aspect 7. The HVAC electrical system power supply packaging system of any of aspects 1-6, further comprising:

a low voltage power supply configured to operate the low voltage component when a hazardous high voltage is not present.

Aspect 8. The HVAC electrical system power supply packaging system of any of aspects 1-7, further comprising:

a control unit configured to provide diagnostic information to an external control unit external the HVAC electrical system power supply packaging system.

Aspect 9. The HVAC electrical system power supply packaging system of aspect 4, further comprising:

a control unit configured to provide VFD operation and diagnostic information to an external control unit external the VFD.

Aspect 10. The HVAC electrical system power supply packaging system of aspect 4, further comprising:

a non-hazardous low voltage power supply included in the first portion; and a control unit configured to direct non-hazardous low voltage from the non-hazardous low voltage power supply to the VFD to drive the VFD high voltage circuitry.

Aspect 11. The HVAC electrical system power supply packaging system of aspect 4, wherein the VFD high voltage circuitry in the VFD is electrically isolated from the VFD low voltage circuitry in the VFD.

Aspect 12. A variable frequency drive (VFD) enclosure for a heating, ventilation and air conditioning (HVAC) electrical system power supply packaging system within an ultimate enclosure, the VFD enclosure comprising:

a VFD, the VFD including:

a low voltage section located on a low voltage side of the VFD that includes VFD low voltage circuitry;

a high voltage section located on a high voltage side of the VFD that includes VFD high voltage circuitry;

a VFD control processor and communications unit configured to provide diagnostic information of the VFD, the VFD control processor and communications unit including a portion of the VFD low voltage circuitry and a portion of the VFD high voltage circuitry, wherein the portion of the VFD low voltage circuitry is electrically isolated from the portion of the VFD high voltage circuitry.

Aspect 13. The VFD enclosure of aspect 12, wherein the VFD includes a low voltage power supply configured to operate the VFD low voltage circuitry when a hazardous high voltage is not present.

Aspect 14. The VFD enclosure of any of aspects 12-13, wherein the high voltage section is configured to drive a motor.

Aspect 15. The VFD enclosure of any of aspects 12-14, further comprising:

a status indicator circuit board provided on an external surface of the VFD, the status indicator circuit board including a status indicator light configured to indicate VFD operation and diagnostic information.

Aspect 16. A variable frequency drive (VFD) for a heating, ventilation and air conditioning (HVAC) electrical system power supply packaging system within an ultimate enclosure, the VFD comprising:

a low voltage portion that includes a low voltage control circuitry component configured to operate at a non-hazardous low voltage level; and a high voltage portion that includes a high voltage circuitry component configured to operate at a hazardous high voltage level, wherein the low voltage control circuitry component is electrically isolated from the high voltage circuitry component.

Aspect 17. The VFD of aspect 16, wherein the low voltage control circuitry component is at least one of an input/output module, a digital signal processor module, a gate drive module, and an identification module.

Article 18. The VFD of any of aspects 16-17, wherein the high voltage circuitry component is at least one of a rectifier section, a DC bus and an inverter section.

Article 19. The VFD of any of aspects 16-18, wherein the non-hazardous low voltage level is about 24 volts maximum.

Article 20. The VFD of any of aspects 16-19, wherein the hazardous high voltage level is a National Electric Code (NEC) class 1 level voltage).

Article 21. The VFD of any of aspects 16-20, wherein the low voltage portion includes a bus indicator module configured to indicate a voltage level of the high voltage circuitry component.

Article 22. The VFD of aspect 21, wherein the bus indicator module includes an indicator configured to indicate to a service provider of the VFD when a voltage level of the high voltage circuitry component is at or below a maximum low voltage level.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What is claimed is:

1. A heating, ventilation and air conditioning (HVAC) electrical system power supply packaging system comprising:

an ultimate enclosure cabinet housing including:

a low voltage compartment including a low voltage component configured to use non-hazardous low voltage power;

a high voltage compartment including a high voltage component configured to use hazardous high voltage power;

a partition configured to physically separate the low voltage component from the high voltage component;

a transparent barrier provided in front of at least one of the low voltage compartment and the high voltage compartment, wherein the transparent barrier is configured to allow a visible indicator for monitoring at least one of the low voltage component and the high voltage component to be viewed external to the ultimate enclosure cabinet housing;

a motor provided in the high voltage compartment as the high voltage component; and a variable frequency drive (VFD) configured to drive the motor, the VFD provided in a VFD enclosure, wherein the low voltage compartment includes low voltage circuitry and the high voltage compartment includes high voltage circuitry that is electrically isolated from the low voltage circuitry, wherein the VFD includes a first portion located on a low voltage side of the VFD that includes VFD low voltage circuitry and a second portion located on a high voltage side of the VFD that includes VFD high voltage circuitry, and wherein the ultimate enclosure cabinet housing is configured to allow service personnel to access the low voltage component in the low voltage compartment without being exposed to hazardous high voltage power;

a utility power supply that supplies hazardous high voltage power to the high voltage compartment; and an external low voltage supply external to the ultimate enclosure cabinet housing and separate from the utility power supply, wherein the external low voltage supply supplies low voltage power to only the low voltage circuitry when hazardous high voltage power is not present for supplying power to the high voltage compartment.

2. The HVAC electrical system power supply packaging system of claim 1, further comprising:

the VFD enclosure including a status indicator circuit board on an external surface of the VFD enclosure, a visible indicator provided on the status indicator circuit board, the visible indicator configured to provide VFD operation and diagnostic information.

3. The HVAC electrical system power supply packaging system of claim 1, further comprising:

a VFD control processor and communications unit provided in the low voltage compartment and configured to provide diagnostic information of the VFD to an external computer.

4. The HVAC electrical system power supply packaging system of claim 1, further comprising:

a non-hazardous low voltage control circuit power supply configured to operate the VFD without the hazardous high power voltage.

5. The HVAC electrical system power supply packaging system of claim 1, further comprising:

a low voltage power supply configured to operate the low voltage component when a hazardous high voltage is not present.

6. The HVAC electrical system power supply packaging system of claim 1, further comprising:

a control unit configured to provide VFD operation and diagnostic information to an external control unit external to the VFD.

7. The HVAC electrical system power supply packaging system of claim 1, further comprising:

a non-hazardous low voltage power supply included in the first portion; and a control unit configured to direct non-hazardous low voltage from the non-hazardous low voltage power supply to the VFD to drive the VFD high voltage circuitry.

8. The HVAC electrical system power supply packaging system of claim 1, wherein the VFD high voltage circuitry in the VFD is electrically isolated from the VFD low voltage circuitry in the VFD.

9. The HVAC electrical system power supply packaging system of claim 1, wherein the low voltage compartment includes one or more of a transformer and an external power supply.

10. The HVAC electrical system power supply packaging system of claim 1, further comprising a plurality of metal oxide varistors provided outside of the VFD.

11. A heating, ventilation and air conditioning (HVAC) electrical system power supply packaging system comprising:

an ultimate enclosure cabinet housing including:

a low voltage compartment including a low voltage component configured to use non-hazardous low voltage power;

a high voltage compartment including a high voltage component configured to use hazardous high voltage power;

a partition configured to physically separate the low voltage component from the high voltage component, and a transparent barrier provided in front of at least one of the low voltage compartment and the high voltage compartment, wherein the transparent barrier is configured to allow a visible indicator for monitoring at least one of the low voltage component and the high voltage component to be viewed external to the ultimate enclosure cabinet housing, wherein the low voltage compartment includes low voltage circuitry and the high voltage compartment includes high voltage circuitry that is electrically isolated from the low voltage circuitry; and a control unit configured to provide diagnostic information to an external control unit external to the HVAC electrical system power supply packaging system, and wherein the ultimate enclosure cabinet housing is configured to allow service personnel to access the low voltage component in the low voltage compartment without being exposed to hazardous high voltage power;

a utility power supply that supplies hazardous high voltage power to the high voltage compartment and an external low voltage supply external to the ultimate enclosure cabinet housing and separate from the utility power supply, wherein the external low voltage supply supplies low voltage power to only the low voltage circuitry when hazardous high voltage power is not present for supplying power to the high voltage compartment.

12. A variable frequency drive (VFD) enclosure for a heating, ventilation and air conditioning (HVAC) electrical system power supply packaging system housed within an ultimate enclosure cabinet housing, the VFD enclosure comprising:

a VFD, the VFD including:

a low voltage section located on a low voltage side of the VFD that includes VFD low voltage circuitry;

a high voltage section located on a high voltage side of the VFD that includes VFD high voltage circuitry;

a VFD control processor and communications unit configured to provide diagnostic information of the VFD, the VFD control processor and communications unit including a portion of the VFD low voltage circuitry and a portion of the VFD high voltage circuitry, wherein the portion of the VFD low voltage circuitry is electrically isolated from the portion of the VFD high voltage circuitry; and a status indicator circuit board provided on an external surface of the VFD, the status indicator circuit board including a status indicator light configured to allow service personnel to obtain VFD operation and diagnostic information without being exposed to hazardous voltage levels, wherein a utility power supply supplies hazardous high voltage power to the VFD high voltage circuitry, and wherein an external low voltage supply external to the ultimate enclosure cabinet housing supplies low voltage power to only the VFD low voltage circuitry when hazardous high voltage power is not present for supplying power to the VFD high voltage circuitry.

13. The VFD enclosure of claim 12, wherein the VFD includes a low voltage power supply configured to operate the VFD low voltage circuitry when a hazardous high voltage is not present.

14. The VFD enclosure of claim 12, wherein the high voltage section is configured to drive a motor.

15. The VFD enclosure of claim 12, wherein the VFD low voltage circuitry includes one or more of an input/output module, a digital signal processer module, a gate drive module, and an identification module and a bus indicator module configured to operate at a non-hazardous low voltage level.

16. The VFD enclosure of claim 15, wherein the bus indicator module is connected to a DC bus and includes an indicator configured to indicate to a service personnel when a voltage level of the VFD high voltage circuitry is at or below a low voltage level to allow the service personnel to safely operate and work with the VFD.

17. The VFD enclosure of claim 12, wherein the VFD high voltage circuitry includes one or more of a rectifier section, a DC bus and an inverter section configured to operate at a hazardous high voltage level.

* * * * *